US006524437B1

(12) United States Patent
Vincent et al.

(10) Patent No.: US 6,524,437 B1
(45) Date of Patent: Feb. 25, 2003

(54) PROCESS FOR PEROXIDE BLEACHING WHEREIN THE CONCENTRATIONS OF MN AND FE ARE MONITORED AND MAINTAINED

(75) Inventors: Adam Hayden Vincent, Blackburn (AU); Ian Alexander McLean, Riddells Creek (AU)

(73) Assignee: Orica Australia Pty. Ltd. (AU)

( * ) Notice: Subject to any disclaimer, the term of this patent is extended or adjusted under 35 U.S.C. 154(b) by 0 days.

(21) Appl. No.: 09/359,330

(22) Filed: Jul. 21, 1999

(30) Foreign Application Priority Data

Jul. 21, 1998 (AU) ..... 4763-98

(51) Int. Cl.[7] ..... D21C 9/16

(52) U.S. Cl. ..... 162/49; 162/61; 162/62; 162/76; 162/78; 162/90

(58) Field of Search ..... 162/76, 78, 60, 162/90, 61, 62, 49

(56) References Cited

U.S. PATENT DOCUMENTS 5,571,378 A * 11/1996 Elofson ..... 162/78
6,056,853 A * 5/2000 Vincent et al. ..... 162/78

FOREIGN PATENT DOCUMENTS

EP 402 335 * 12/1990 ..... 162/78
EP 595 386 * 12/1990 ..... 162/78

* cited by examiner

*Primary Examiner*—Steve Alvo
(74) *Attorney, Agent, or Firm*—Cantor Colburn LLP

(57) ABSTRACT

A process for peroxide bleaching of pulp using magnesium oxide or magnesium hydroxide as a substitute for caustic soda wherein the pulp is bleached in the presence of hydrogen peroxide characterized in that the concentration of ion present in the magnesium oxide or magnesium hydroxide and the pulp is maintained less than 20 ppm and/or the concentration of manganese is maintained less than 10 ppm.

1 Claim, 8 Drawing Sheets

Effectiveness of chelants with increasing Fe levels (excess chelant doses)

FIG. 1 Effect on brightness of Fe and Mn ions

FIG. 2 Effectiveness of chelants with increasing Fe levels (cost comparative doses)

FIG. 3 Effectiveness of chelants with increasing Mn levels (cost comparative basis)

FIG. 4 Effectiveness of chelants with increasing Fe levels (excess chelant doses)

FIG. 5 Effectiveness of chelants with increasing Mn levels (excess chelant doses)

FIG. 6 Effect of chelants on brightness when pulp is bleached with MgO containing high Fe levels Hydrating effect on brightness gain over time

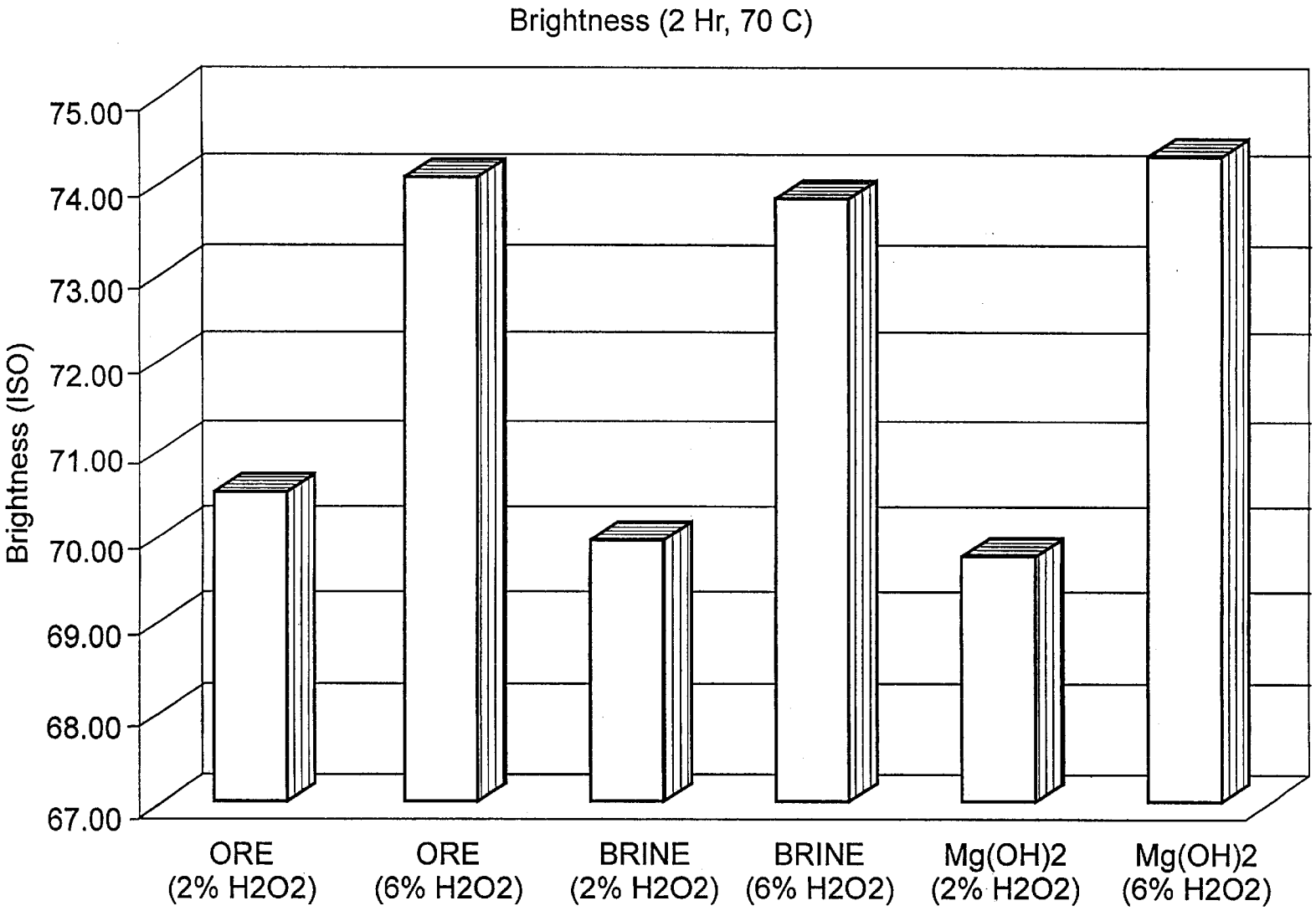
FIG. 8 Comparison of MgO and $Mg(OH)_2$

PROCESS FOR PEROXIDE BLEACHING WHEREIN THE CONCENTRATIONS OF MN AND FE ARE MONITORED AND MAINTAINED

BACKGROUND OF THE INVENTION

1. Technical Field

THIS INVENTION relates to peroxide bleaching of pulp.

Pulp bleaching is the chemical process that alters the colour giving components within the pulp to give it a higher brightness. In a conventional peroxide bleaching process, alkali is required to react wit the peroxide to generate a perhydroxy ion ($HOO^-$), the bleaching agent responsible for the bleaching reaction.

2. Background

Typically the alkali used in peroxide bleaching is sodium hydroxide, but it has a number of disadvantages associated with its use. The main problem being a competing reaction that occurs between the caustic and the pulp. This reaction is the yellowing reaction, and as the name suggests, causes the pulp to yellow in colour.

A process that describes peroxide bleaching which utilizes magnesium oxide as a sole alkaline source has been described in International Publication No. WO96/41917. It was found that the brightness levels obtained using MgO were very close to that which is achieved by conventional bleaching using NaOH. A number of benefits have been found in the use of MgO as the sole alkali source including cost savings over the caustic system, buffering action, no yellowing reaction and improved handling conditions as MgO is not a dangerous product.

More specifically International Publication No. WO96/41917 referred to a process wherein the pulp is bleached in the presence of hydrogen peroxide for a maximum period of 180 minutes to achieve an ISO brightness of 65 in regard to freshly prepared pulp characterized in that the magnesium oxide is utilized as MgO particles having a particle size of 5–500 microns and a particle surface area of between 20–60 $m^2/g$. A preferred particle size is less than 75 microns and more preferable 30–50 $m^2/g$.

However, the process described in International Publication No. WO96/41917 was unduly restricted in relation to the maximum ISO brightness of 65 as well as the maximum bleaching time of 180 minutes. These factors impaired commercial viability of this bleaching process especially when high 180 brightness levels greater than 65 were required in certain situations Surprisingly, it has now been discovered that higher brightness levels can be more efficiently achieved by monitoring the concentration of transition metals in the source of magnesium oxide and/or by the choice of chelating agent used in the bleaching process.

DISCLOSURE OF INVENTION

Therefore, in one aspect of the present invention, there is provided a process for peroxide bleaching of pulp using magnesium oxide or magnesium hydroxide as a substitute for caustic soda Wherein the pulp is bleached in the presence of hydrogen peroxide characterized in that the concentration of iron present in the magnesium oxide or magnesium hydroxide and the pulp is maintained less than 20 ppm and/or the concentration of manganese is maintained less than 10 ppm.

It has now been ascertained that if the concentrations of manganese and iron exceed the above levels then the efficiency of the bleaching process may be adversely affected because such relatively high concentrations of iron or manganese by reacting with the peroxide will decrease the peroxide concentration to below the optimum concentrations required.

In regard to this aspect of the invention, it will be appreciated that iron and/or manganese will be present both in the magnesium oxide and the pulp and thus it Is therefore necessary to monitor the total concentration of iron and/or manganese present.

It is well known that transition metal ions may be removed by a washing step prior to bleaching of pulp and this is usually achieved by the use of DTPA In the case of International Publication No. WO96/41917 a further dose of DTPA is added to the pulp during bleaching. However, it could not have been predicted that by minimizing the Mn and/or Fe levels in the MgO, and therefore maintaining the levels below the above concentrations that higher target ISO brightness could be more efficiently achieved by the specific process described in International Publication No. WO96/41917.

In another aspect of the invention, there is provided a process for peroxide bleaching of pulp using magnesium oxide or magnesium hydroxide as a substitute for caustic soda wherein the pulp is bleached in the presence of hydrogen peroxide characterized in that a bleach solution comprising the pulp and the magnesium hydroxide or magnesium oxide has a chelating agent which is selected from a group consisting of a chelating agent having a phosphinic acid moiety, a chelating agent not having a phosphinic acid moiety and silicate in accordance with the following criteria:

(a) when the concentration of Mn in the bleach solution is greater than 10 ppm, the chelating agent is chosen from the chelating agent having a phosphinic acid moiety and a chelating agent not having a phosphinic acid moiety;

(b) when the Fe concentration is greater than 20 ppm, the chelating agent is silicate; and (c) if silicate is to be avoided as a chelating agent in the case when the Fe concentration is greater than 20 ppm, the chelating agent has a phosphinic acid moiety.

The particle size of the MgO particles or $Mg(OH)_2$ particles is less than 500 microns and preferably less than 75 microns. The surface area of the $Mg(OH)_2$ or MgO particles is preferably 20–60 $m^2/g$ and more preferably 30–50 $m^2g$.

The chelating agent having a phosphinic acid moiety is preferably DTPMPA (i.e. diethylene triamine pentamethylene phosphonic acid). The chelating agent not having a phosphinic acid moiety may be selected from DTPA (diethylene triamine penta acetic acid), EDTA (ethylene diamine tetra acetic acid) and HEDTA (hydroxethylene diamine tetra acetic acid).

In relation to the use of silicate as a chelating agent, preferably use is made of an alkali metal silicate such as sodium silicate or potassium silicate.

It is also the case that criteria (a) and (b) above may apply together, i.e. when the concentration of iron in the bleach solution is greater than 20 ppm and the concentration of manganese in the bleach solution is greater than 10 ppm, both chelating agents (i.e. the chelating agent having the phosphinic acid moiety and silicate) may be added.

The dosages of MgO that may be utilized in the process of the invention are preferably 0.3–2% based on the weight of the pulp.

The amount of hydrogen peroxide that may be utilized in the process of the invention is from 1–6% based on the weight of the pulp.

To achieve maximum efficiency, the MgO particles are preferably added to the pulp in the form of a powder or slurry prepared in situ.

Preferably the MgO is added to the pulp simultaneously with the peroxide or prior to the addition of the peroxide.

Also, to achieve maximum efficiency, the $Mg(OH)_2$ should be manufactured by precipitation using $MgCl_2$ as opposed to hydration of MgO.

It has now been demonstrated if either aspect of the invention as described above is followed, then a target ISO brightness of above 65 may be achieved, i.e; of the order of 70–80. Thus, the target ISO brightness may be from 55–80. The bleaching time of 180 minutes referred to in International Publication No. WO96/41917 may also be exceeded if desired. Thus, the bleaching time may be unlimited.

The purpose of this work is to determine.

(i) the effect of metal ions (Fe and Mn) contained in MgO on the bleaching efficiency of MgO based peroxide bleaching; and (ii) the most effective metal chelating agent for Fe and Mn in an MgO based bleaching process.

Preferably the pulp before the bleaching step is washed with 0.1–0.5% v/w DTPA based on the pulp. This concentration of chelating agent may also be used in the bleach solution.

BRIEF DESCRIPTION OF THE DRAWINGS

Reference may be made to a preferred embodiment of the invention as shown in the attached drawings, wherein:

FIG. 8 shows comparison of MgO and $Mg(OH)_2$ as discussed in the Experimental Section.

EXPERIMENTAL

Part 1 Effect of Metal Ions

TMP pulp was used to carry out this work Prior to bleaching, the pulp was treated with DTPA in order to remove as many metal ions as possible It was assumed that, after treatment, the pulp contained 10 ppm Fe and 5 ppm Mn. 10 gOD samples of this pulp were bleached using an analytical grade of MgO, peroxide and increasing amounts of Fe or Mn solution. Chemicals were added to the pulp samples and mixed well before being bleached for two hours at 70° C. 3 gOD of pulp was taken from each sample and a handsheet produced The brightness of each sheet was measuring using a Technidyne Handy-Brite meter. The results are shown in Table 1.

Part 2 Effectiveness of Chelating Agents in the Presence of Fe or Mn

The same procedure as above was used with the exception that a chelant, chosen from either DTPA, DTPMPA or silicate was added to the samples. This work was repeated twice. Firstly, the chelant doses were calculated based on the theoretical amount of DPTA using the assumption that 55 mg of ions are chelated for every 1 g of DTPA (50%) added. DTPMPA and silicate doses were then calculated on a cost equivalent basis of the DTPA. The second repetition involved dosing excess amount of each chelant. The results are shown in Tables 2 and 3.

Discussion

Figure 1:
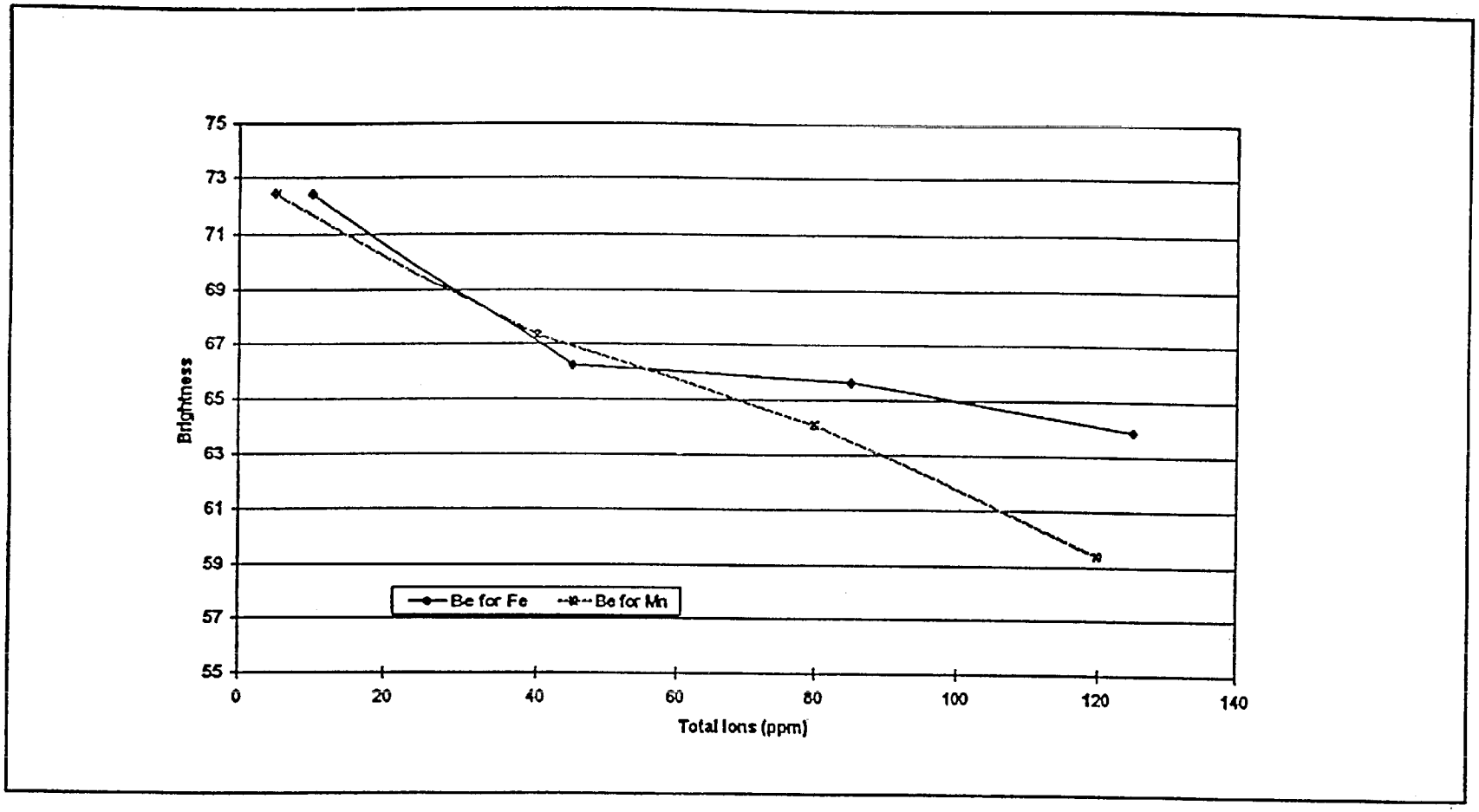
FIG. 1 shows, the effect of brightness of Fe and Mn ions as discussed in the Experimental Section.

Part 1 was designed in order to see the effect of individual ions present in MgO, in particular, Fe and Mn, on the bleaching efficiency of peroxide. This was done by adding incremental amounts of ion solution to the pulp and measuring the resulting brightness. These are plotted in FIG. 1.

As expected, there was a detrimental effect on brightness With increased doses of both Fe and Mn. As a rule, if the total Fe and Mn are less than 10 ppm and 5 ppm respectively, then there should be no significant effect on the bleached brightness of the pulp. Given the pretreatment of the pulp prior to bleaching, it can be assumed that any change in brightness was due to the on additions.

Figure 2:
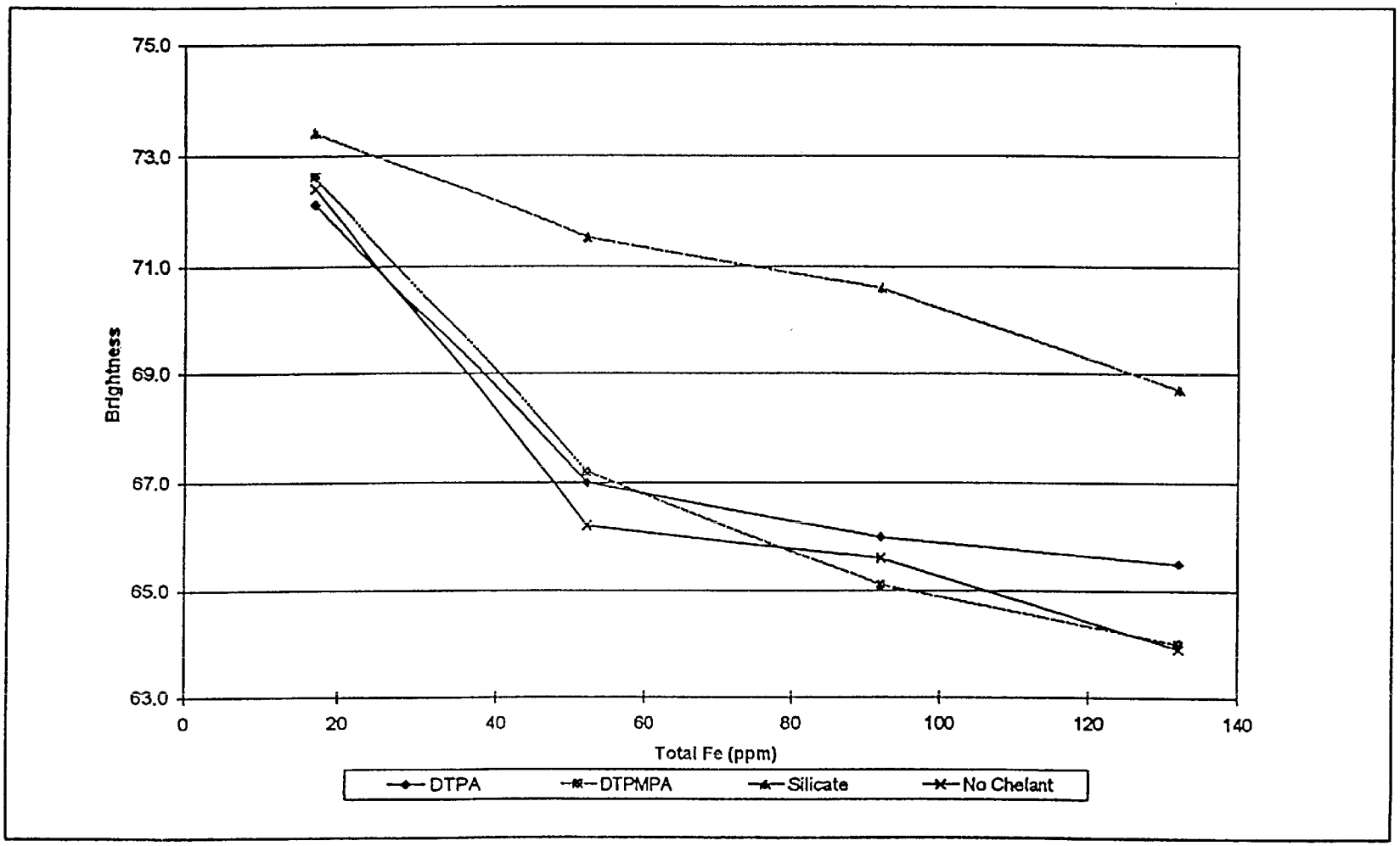
FIG. 2 shows the effectiveness of increasing Fe levels as discussed in the Experimental Section.
Figure 3:
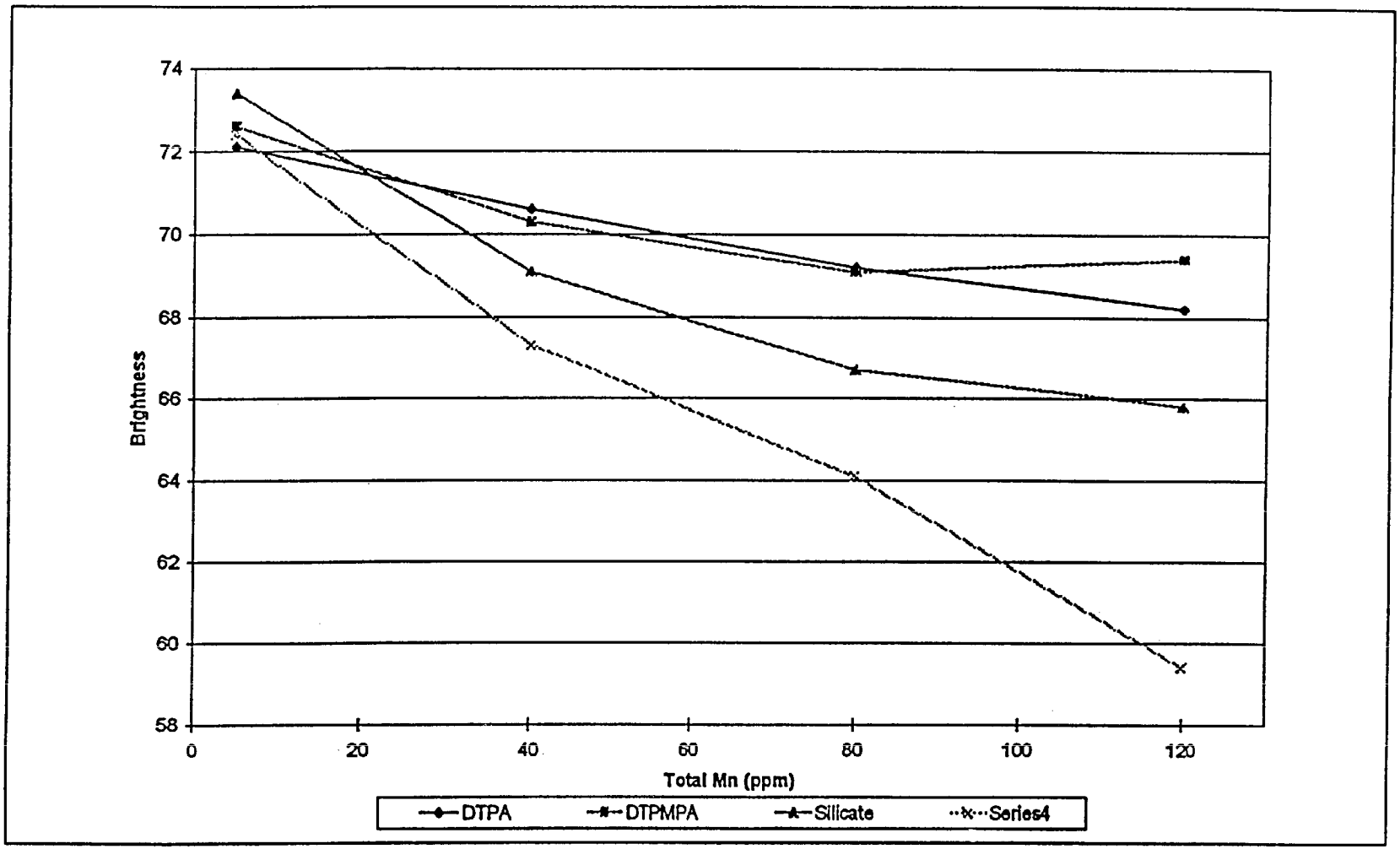
FIG. 3 shows the effectiveness of chelants with increasing Mn levels as discussed in the Experimental Section.

Increasing the total Mn causes a steady decrease in brightness resulting in a 17.5 point brightness drop at 120 ppm. Fe is slightly different in that there is an initial loss of 6 points with the first addition of Fe ions. The rate of decrease then flattens out at higher concentration levels. A total brightness loss of 8.5 points was seen at 125 ppm Fe. The results for Part 2 are shown in FIGS. 2 and 3. The aim of this work was to see how well different chelants performed in the presence of Fe and Mn and how increasing the doses of these ions affect each one.

Silicate provided to be the beat performing chelant in the presence of Fe. Table 1 shows that with silicate in the system, a higher initial brightness is achieved and the rate of brightness decrease with increasing Fe is less than for DTPA and DTPMPA.

The results for Mn show that both DTPA and DTPMPA work very well in chelating this ion and gave relatively stable brightnesses over the range of Mn dosed. Silicate, although not quite as good, also achieved reasonable results at low levels (<40 ppm) but the performance dropped off as the Mn concentration increased.

Figure 4:
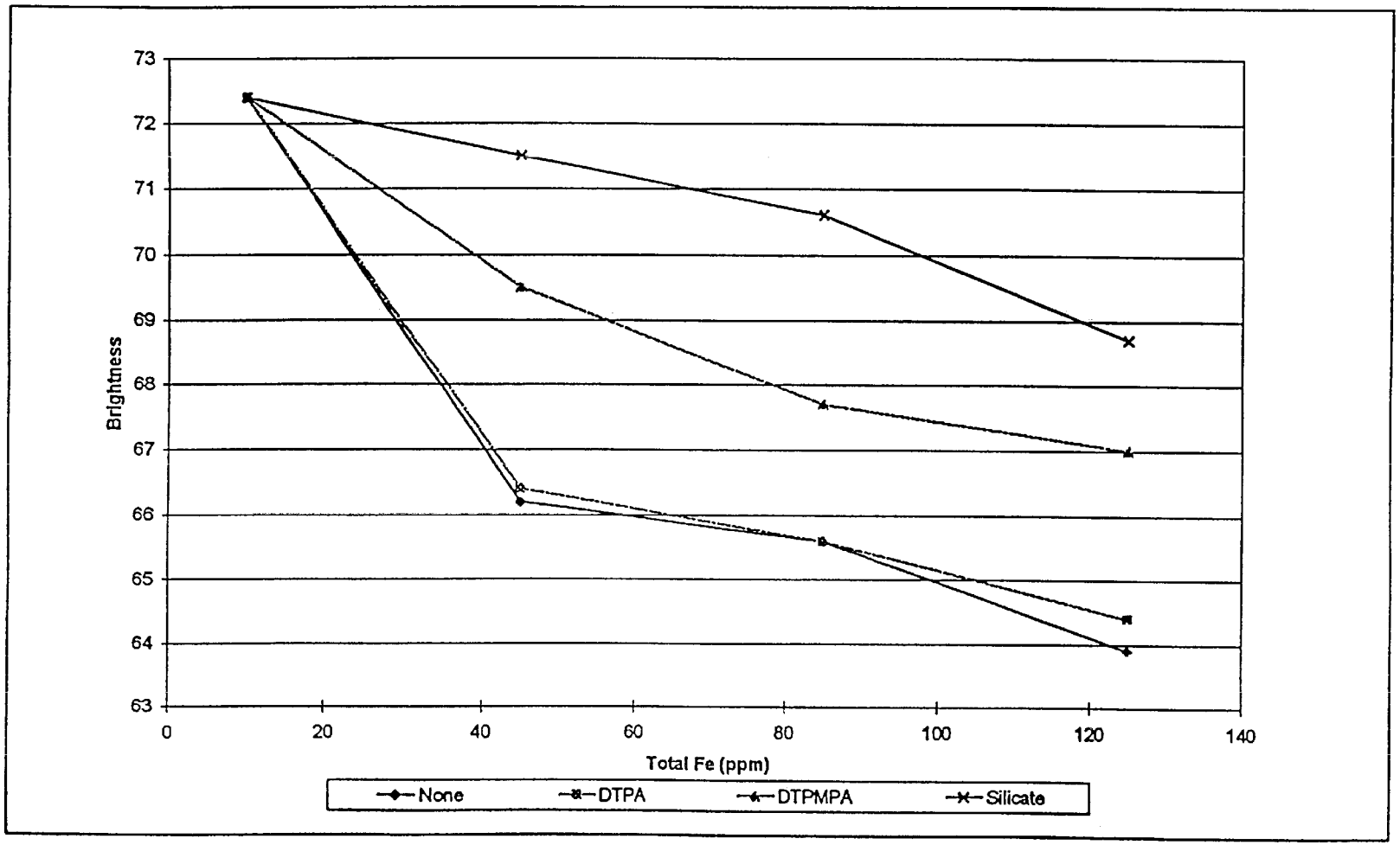
FIG. 4 shows the effectiveness of chelants with increasing Fe levels (excess chelant doses) as discussed in the Experimental Section; Ad.
Figure 5:
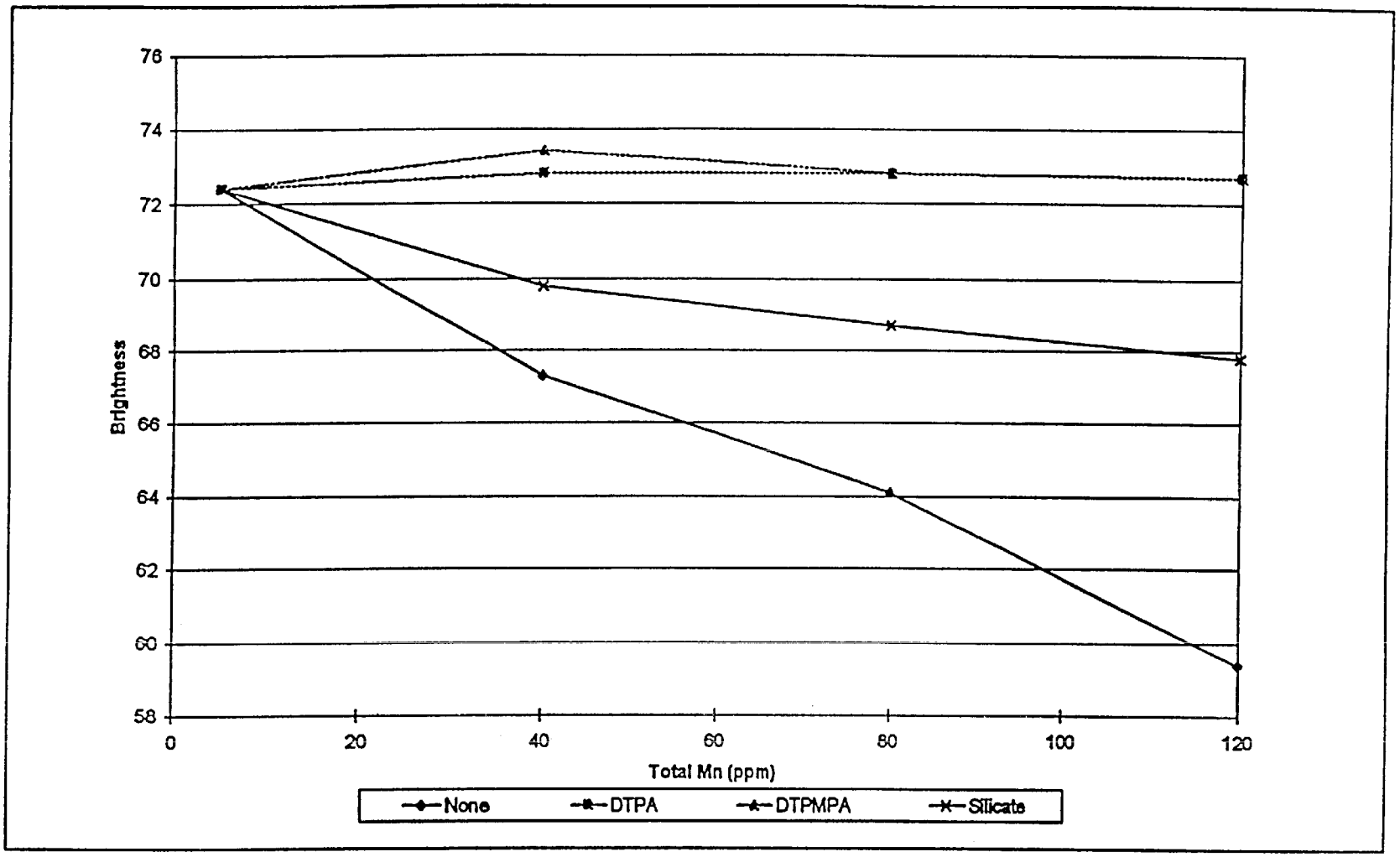
FIG. 5 shows effectiveness of chelants with increasing Mn levels (excess chelant doses) as discussed in the Experimental Section.

FIGS. 4 and 5 show the results for the samples bleached with excess amounts of each chelant. The only variation observed was a 2–3 point brightness increase with DTPMPA in the presence of Fe. This indicates that the dose calculated on the basis of cost was not high enough.

Figure 6:
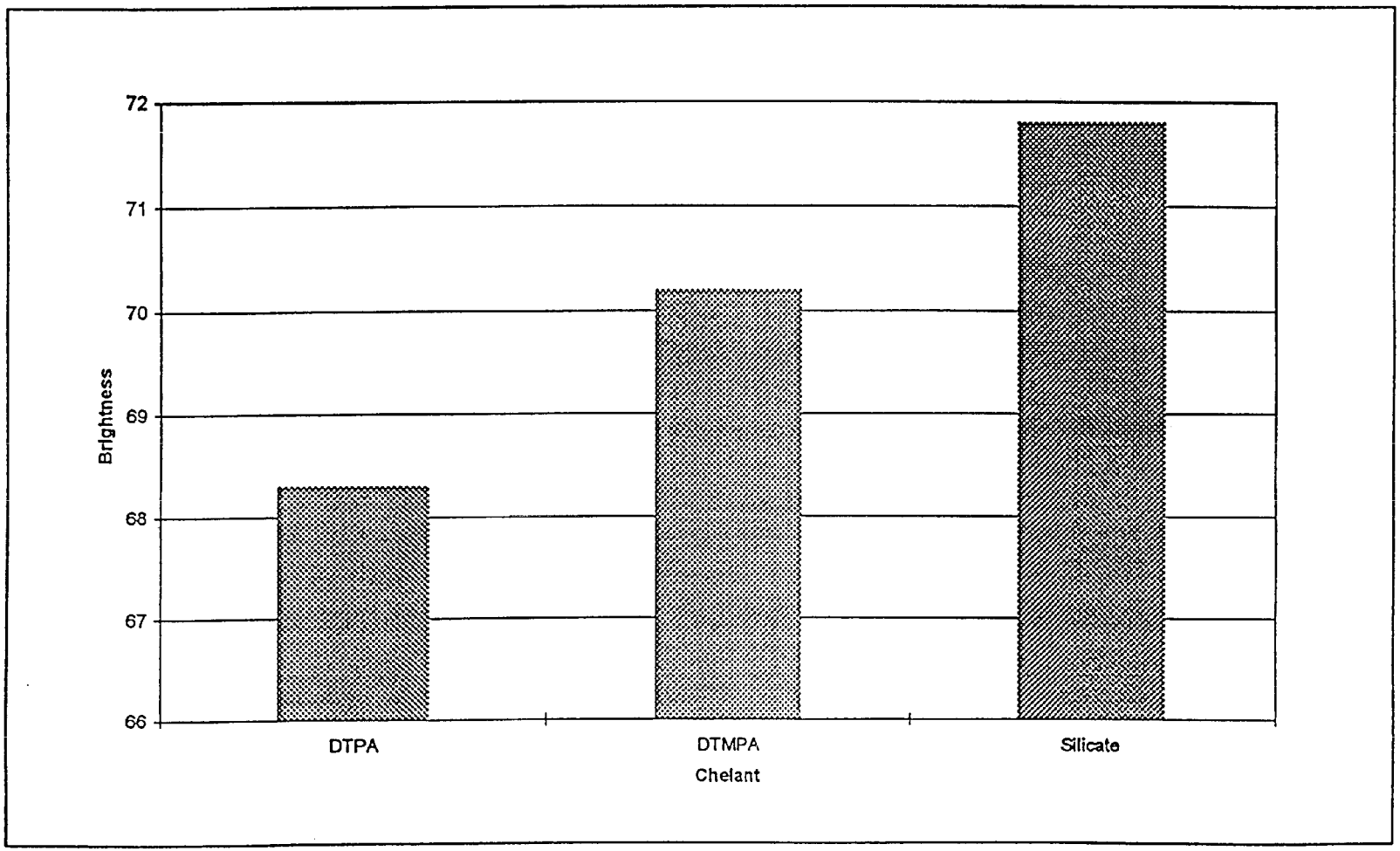
FIG. 6 shows effect of chelants on brightness when pulp is bleached with MgO containing high Fe levels as discussed in the Experimental Section.

To verify the results, a commercial grade of MgO containing high levels of Fe was used for bleaching. The chelants were dosed in excess and the total Fe concentration in the process was 92 ppm (8 ppm from the pulp plus 84 ppm from the MgO) FIG. 6 shows that the same pattern of performance for the chelants was achieved, i.e. silicate produces the best result, followed by DTPMPA and DTPA.

Conclusion

From the results of this work, the following conclusions were made:

(1) Metal ions introduced into an MgO base peroxide bleaching process will effect the efficiency of that process.

(2) When the total Fe concentration in the process is high (>20 ppm), the best chelant to use is silicate.

(3) When there are high levels of Mn (>10 ppm) present, either DTPA or DTPMPA will give the best results.

(4) If there is a requirement for the process to be silicate free, DTPMPA is the preferred chelant.

(5) If the total concentration of Fe and Mn are both high, a combination of silicate and DTPA could be used.

PART 3

There were two main aims of this work:

(1) to compare the performance of precipitated $Mg(OH)_2$ from brine with that of MgO. Two MgO sources were investigated; and (2) to determine the effect of hydration on the performance of MgO as a bleach alkali.

Testing Regime

Part A Bleaching Performance (1) Bleach comparison (look at two peroxide levels).

Part B Hydration Study (1) Close observation (eight hour time period);

(2) Extended hydration time; and (3) Elevated temperature hydration.

Laboratory Program

Part A Bleach Comparison

"Standard mill conditions"

Pulp: TMP washed
Sample size: 10 g OD pulp
Peroxide: 2%, 6% OD pulp
Alkali: MgO and $Mg(OH)_2$
Time: 2 hours
Consistency: 12% OD pulp
Temp: 70° C.
Chelant: DTPA Bleaching chemicals were added to the pulp and stirred for two minutes. Samples were then sealed in plastic bags and incubated in a water bath for two hours at 70° C. Brightnesses were measured using a Technidyne Handy—Brite Brightness Meter, where brightness is defined as the reflectance of light at 457 nm. Measured as a percentage against a pure magnesium oxide standard, i.e. MgO standard equals brightness of 100%.

Part B Hydration Study

Slurry Preparation

Alkali: MgO or $Mg(OH)_2$
Temp: Ambient
Slurry: 10% w/v

Slurry samples were prepared in open top beakers and stirred using magnetic stirrers. The temperature of the hydration was the ambient temperature of the laboratory (22° C.).

Bleaching Conditions

Pulp: TMP wasned
Sample size: 10 g OD pulp
Peroxide: 6% OD pulp
Alkali: MgO (various stages of hydration)
Time: 2 hours
Consistency: 12% OD pulp
Temp: 70° C.
Chelant: DTPA Bleaching chemicals were added to the pulp and stirred for two minutes. Samples were then sealed in plastic bags and incubated in a water bath for two hours at 70° C. Brightnesses were measured using a Technidyne Handy—Brite Brightness Meter, where brightness is defined as the reflectance of light at 457 nm. Measured as a percentage against a pure magnesium oxide standard, i.e. MgO standard equals brigtness of 100%.

Elevated Temperature Hydration

The slurry samples prepared earlier were heated to 80° C. for two hours (after week long hydration), then tested using bleaching conditions above.

Results & Discussion

Samples of MgO and $Mg(OH)_2$ were tested to compare their performance at two peroxide levels using constant conditions (standard mill conditions). The samples were from two sources of manufacture, calcined from ore and precipitated from $MgCl_2$ rich brine. A commercial grade of magnesium hydroxide, manufactured from brine was also assessed. The alkali activities of these samples in the bleaching reaction were equivalent under the standard mill conditions (FIG. 8).

Figure 7:
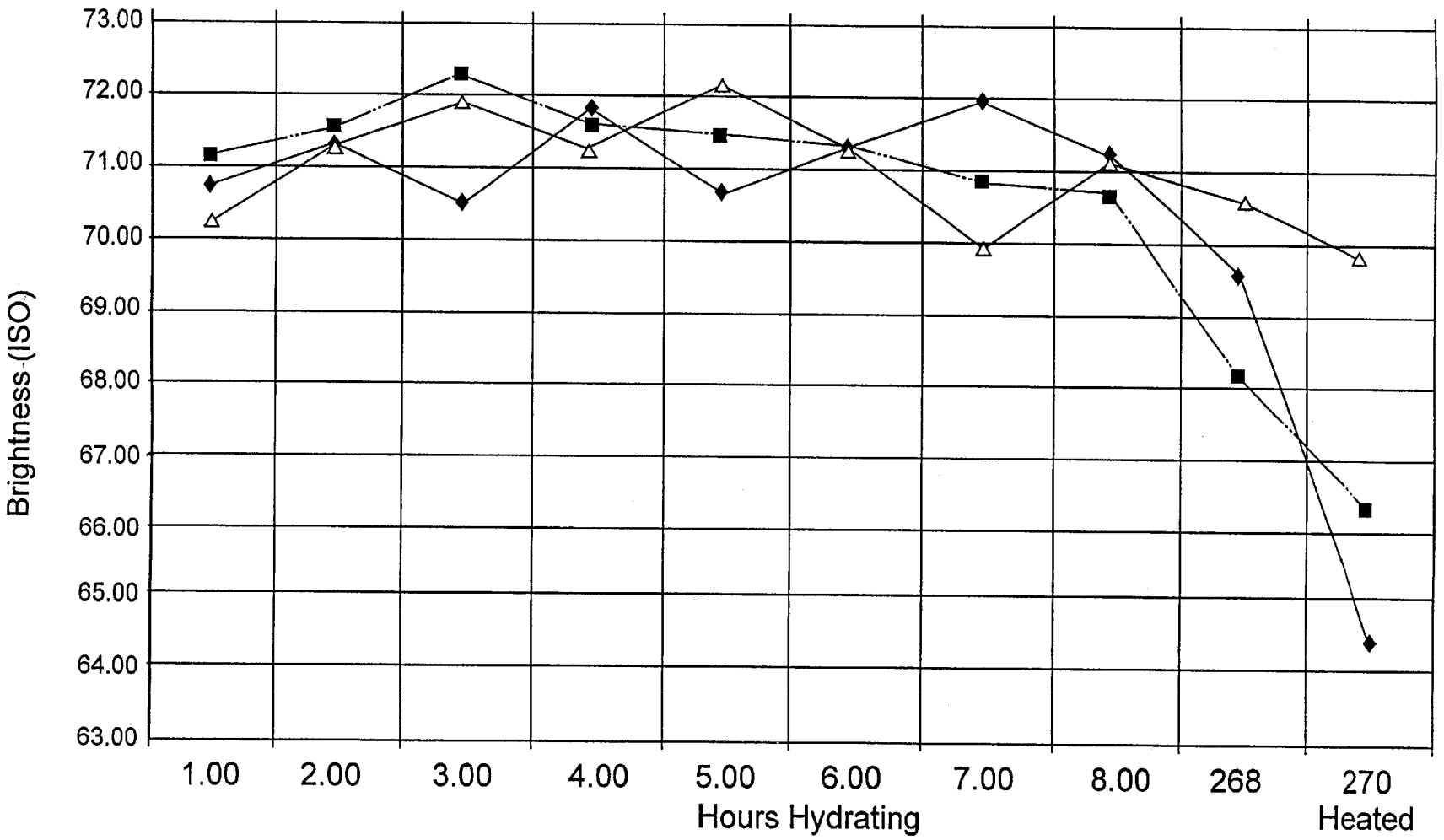
FIG. 7 shows hydration effect on brightness gain over time as discussed in the Experimental Section.

Hydration studies were conducted on the three samples. The hydration study was conducted in three parts. The first part involved close observation for the first eight hours of hydration, where sample were taken hourly. During the first eight hours of hydration, the performance of each of the alkalis was comparable. The samples were then left for a week (268 hours) and then retested. After this extended hydration reaction time, the MgO samples exhibited a degree of activity loss compared to the earlier eight hour hydration trend, the hydroxide sample, however, showed no loss of activity. The week long hydration samples were then heated to 80° C. for two hours. The exposure to heat significantly reduced the activity of the MgO samples, whereas the hydroxide sample was relatively unchanged (FIG. 7).

Conclusion

Either MgO (calcined or precipitated) or $Mg(OH)_2$ (from precipitated brine) are suitable for the peroxide bleaching reaction. However, it is important that when using MgO as the alkali, it is not kept in the slurry form for extended periods (greater than eight hours) due to minor activity losses. The MgO must not be heated whilst in the aqueous form due to major activity losses.

TABLES

TABLE 1

Total ion concentrations added to pulp samples

| Sample | Total Fe (ppm*) | Be for Fe | Total Mn (ppm*) | Be for Mn |
|---|---|---|---|---|
| 1 | 10 | 72.4 | 5 | 72.4 |
| 2 | 45 | 66.2 | 40 | 67.3 |
| 3 | 85 | 65.6 | 80 | 64.1 |
| 4 | 125 | 63.9 | 120 | 54.9 |

*ppm = parts per million on OD pulp

TABLE 2

Chelant doses and brightness results for Fe

| | DTPA | | DTPMPA | | SILICATE | |
|---|---|---|---|---|---|---|
| Sample | Dose (%) | Be | Dose (%) | Be | Dose (%) | Be |
| 1 | 0.1 | 72.1 | 0 | 72.6 | 0.4 | 73.4 |
| 2 | 0.1 | 67.0 | 0 | 67.2 | 0.4 | 71.5 |
| 3 | 0.1 | 66.0 | 0.1 | 65.1 | 0.8 | 70.6 |
| 4 | 02 | 65.5 | 0.1 | 64.0 | 1.2 | 68.7 |

TABLE 3

Chelant doses and brightness results for Mn

| | DTPA | | DTPMPA | | SILICATE | |
|---|---|---|---|---|---|---|
| Sample | Dose (%) | Be | Dose (%) | Be | Dose (%) | Be |
| 1 | 0.1 | 72.1 | 0 | 72.5 | 0.4 | 73.4 |
| 2 | 0 1 | 70.6 | 0 | 70.3 | 0 4 | 69 1 |
| 3 | 0.1 | 69.2 | 0.1 | 69.1 | 0.8 | 66.7 |
| 4 | 0.2 | 68.2 | 0.1 | 69.4 | 1.2 | 65.8 |

What is claimed is:

1. A process for peroxide bleaching of pulp comprising, treating pulp using a peroxide bleaching solution comprising at least one of magnesium oxide and magnesium hydroxide;

maintaining the concentration of Mn to less than 10 ppm and the concentration of Fe to less than 20 ppm by selecting a chelating agent and adding the selected chelating agent to the peroxide bleaching solution in accordance with the following criteria:

monitoring a concentration of Mn in the peroxide bleaching solution and when the Mn concentration is greater than 10 ppm adding a chelating agent selected from the group consisting of DTPMPA, DTPA, EDTA and HEDTA, and;

monitoring the concentration of Fe in the peroxide bleaching solution and when the Fe concentration is greater than 20 ppm adding a chelating agent comprising an alkali metal silicate.

* * * * *